US009908303B2

(12) United States Patent
Lai

(10) Patent No.: US 9,908,303 B2
(45) Date of Patent: Mar. 6, 2018

(54) FOLDABLE BOX SEALING MACHINE

(71) Applicant: EXPACK INDUSTRIAL CORPORATION, Taichung (TW)

(72) Inventor: Yu-Ting Lai, Taichung (TW)

(73) Assignee: Expack Indutrial Corporation, Taichung (TW)

( * ) Notice: Subject to any disclaimer, the term of this patent is extended or adjusted under 35 U.S.C. 154(b) by 508 days.

(21) Appl. No.: 14/526,969

(22) Filed: Oct. 29, 2014

(65) Prior Publication Data

US 2015/0321437 A1 Nov. 12, 2015

(30) Foreign Application Priority Data

May 8, 2014 (TW) ..... 103208054 U

(51) Int. Cl.

| | |
|---|---|
| ***B65D 51/06*** | (2006.01) |
| ***B31B 3/72*** | (2006.01) |
| ***B65B 7/16*** | (2006.01) |
| ***B65B 51/06*** | (2006.01) |
| ***B65B 65/00*** | (2006.01) |
| ***B31B 50/72*** | (2017.01) |
| *B31B 100/00* | (2017.01) |
| *B31B 50/00* | (2017.01) |

(52) U.S. Cl.

CPC ..... *B31B 3/72* (2013.01); *B31B 50/72* (2017.08); *B65B 7/16* (2013.01); *B65B 51/067* (2013.01); *B65B 65/00* (2013.01); *B31B 50/004* (2017.08); *B31B 2100/00* (2017.08)

(58) Field of Classification Search

CPC ..... B65B 51/067; B65B 65/00; B65B 7/16; B65B 7/2864; B31B 3/72; B31B 2201/29

See application file for complete search history.

(56) References Cited

U.S. PATENT DOCUMENTS

2011/0239596 A1* 10/2011 Thomas ..... B65B 61/02 53/476

FOREIGN PATENT DOCUMENTS

DE 2651431 A1 * 6/1977 ..... B65B 51/067

OTHER PUBLICATIONS

Translation of DE 2651431 A1, Augusto Marchetti, Jun. 1977, all pages.*

* cited by examiner

*Primary Examiner* — George Koch
(74) *Attorney, Agent, or Firm* — McNees Wallace & Nurick LLP

(57) ABSTRACT

A foldable box sealing machine includes an upright main frame unit, an upper taping unit mounted on the main frame unit, a platform unit having a base panel mounted rotatably on the main frame unit below the upper taping unit, a lower taping unit disposed below the upper taping unit. The base panel is rotatable between a first position where the base panel is substantially horizontal, and a second position where the base panel is substantially vertical.

11 Claims, 5 Drawing Sheets

FOLDABLE BOX SEALING MACHINE

CROSS REFERENCE TO RELATED APPLICATION

This application claims priority of Taiwanese Application Number 103208054, filed on May 8, 2014.

FIELD OF THE INVENTION

The invention relates to a box sealing machine, and more particularly to a box sealing machine that has a folding function.

BACKGROUND OF THE INVENTION

A conventional box sealing machine includes a pair of spacedly disposed upright frame members, a support platform mounted between the upright frame members, and an upper adhesive tape unit and a lower adhesive tape unit disposed respectively above and below the support platform. After an upper adhesive tape and a lower adhesive tape are loaded respectively on the upper adhesive tape unit and the lower adhesive tape unit, a box placed on the support platform may be conveyed through the upper and lower adhesive tapes to seal the top and bottom sides of the box using the adhesive tapes.

However, when the conventional box sealing machines of the above-mentioned type are packaged and transported, inconveniences can occur because the bulky volumes of the upright frame members and the support platform occupy considerably large spaces in packaging and transporting tools and produce difficulties in transporting operations.

SUMMARY OF THE INVENTION

An object of the invention is to provide a foldable box sealing machine that can be conveniently packaged and transported.

According to one aspect of the invention, a foldable box sealing machine for sealing a box, comprises: a main frame unit extending uprightly from a bottom end to a top end thereof; an upper taping unit mounted on the main frame unit in proximity to the top end; a platform unit having a base panel mounted rotatably on the main frame unit below the upper taping unit; and a lower taping unit mounted on the main frame unit below the upper taping unit. The base panel is rotatable between a first position where the base panel lies on a plane substantially parallel to a conveying direction (W) along which the box is conveyed during a box sealing operation, and a second position where the base panel extends substantially parallel to a top-bottom direction of the main frame unit.

According to another aspect of the invention, a foldable box sealing machine for sealing a box, comprises: a platform unit adapted for placement of the box to be sealed and including a base panel; and a main frame unit connected to the platform unit. The base panel is rotatable relative to the main frame unit between a first position, where the base panel lies substantially horizontally to permit the box to undergo a box-sealing operation, and a second position, where the base panel is substantially vertical at a front or rear side of the main frame unit.

According to further aspect of the invention, a foldable box sealing machine for sealing a box, comprises: two spaced apart upright frame members; an upper taping unit including an upper shaft unit connected between the upright frame members, and an upper case that is mounted to the upper shaft unit to rotate between the upright frame members; a platform unit having a base panel mounted rotatably between the upright frame members below the upper case; and a lower taping unit mounted between the upright frame members below the upper taping unit. The base panel is rotatable between a first position, where the base panel is substantially horizontal, and a second position where the base panel is substantially vertical. When the base panel is in the first position, the upper case is in a position where the upper case extends substantially horizontally. When the base panel is rotated to the second position, the upper case is rotated to a position where the upper case extends substantially vertically.

BRIEF DESCRIPTION OF THE DRAWINGS

Other features and advantages of the present invention will become apparent in the following detailed description of the embodiment with reference to the accompanying drawings, of which.

DETAILED DESCRIPTION OF THE EMBODIMENT

Figure 1:
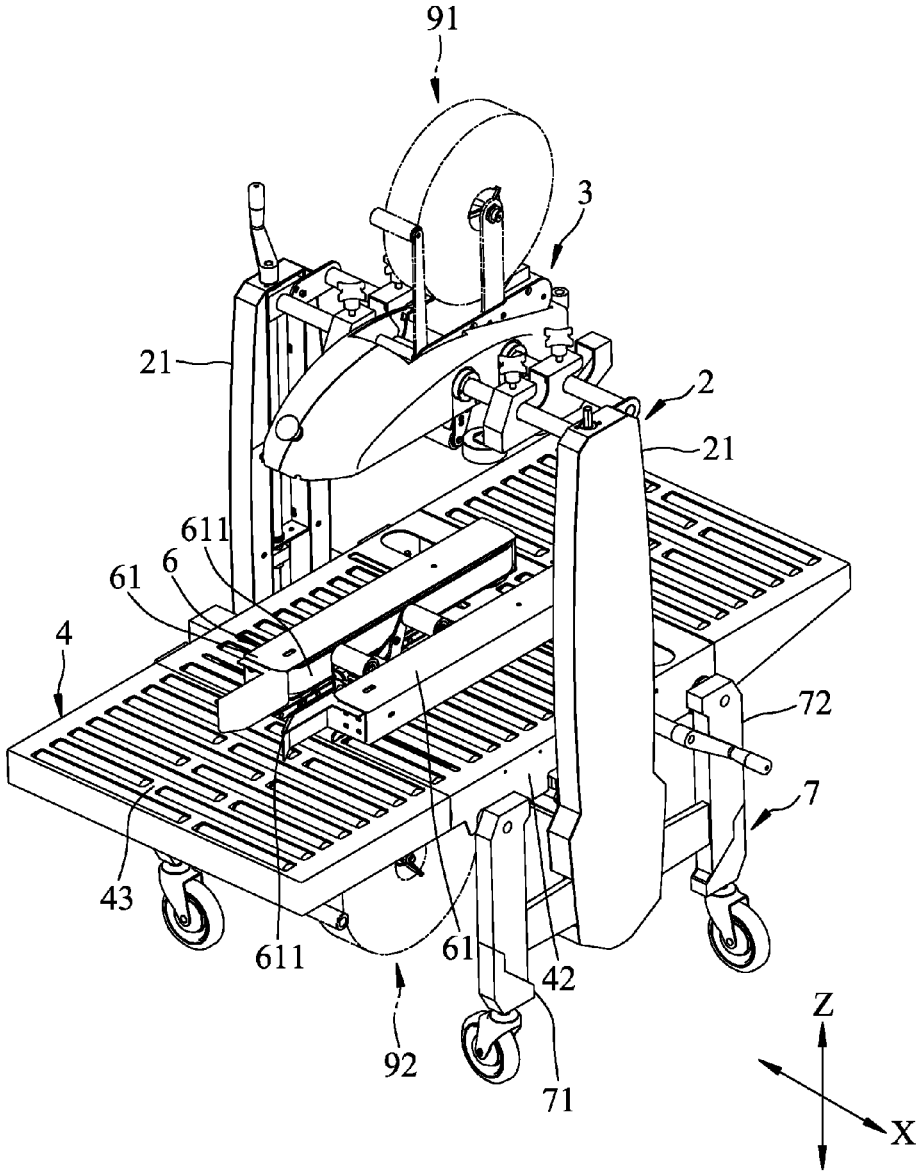
FIG. 1 is a perspective view of a foldable box sealing machine according to the embodiment of this invention in an unfolded state.
Figure 2:
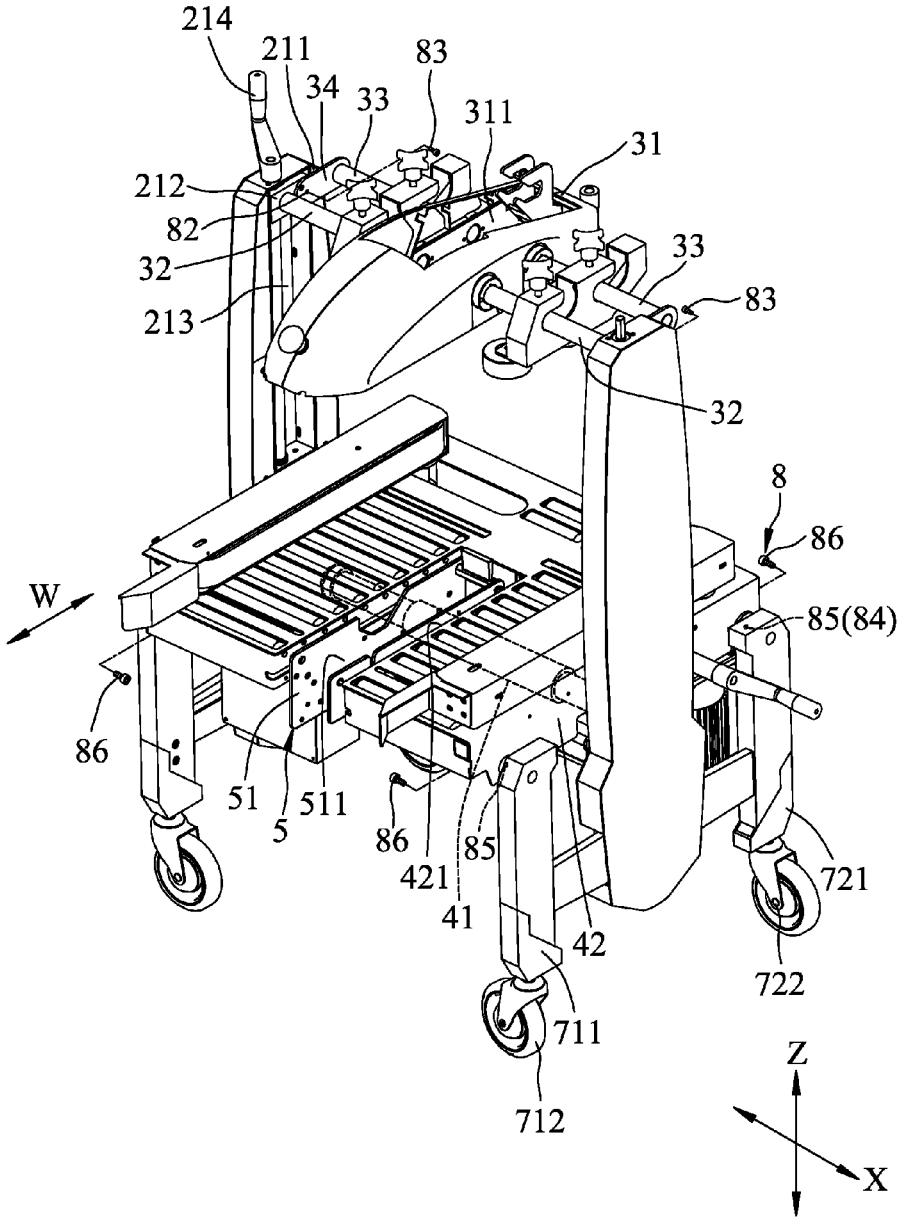
FIG. 2 is the same view as FIG. 1 but illustrating that an extension panel is removed from a base panel of the foldable box sealing machine.
Figure 3:
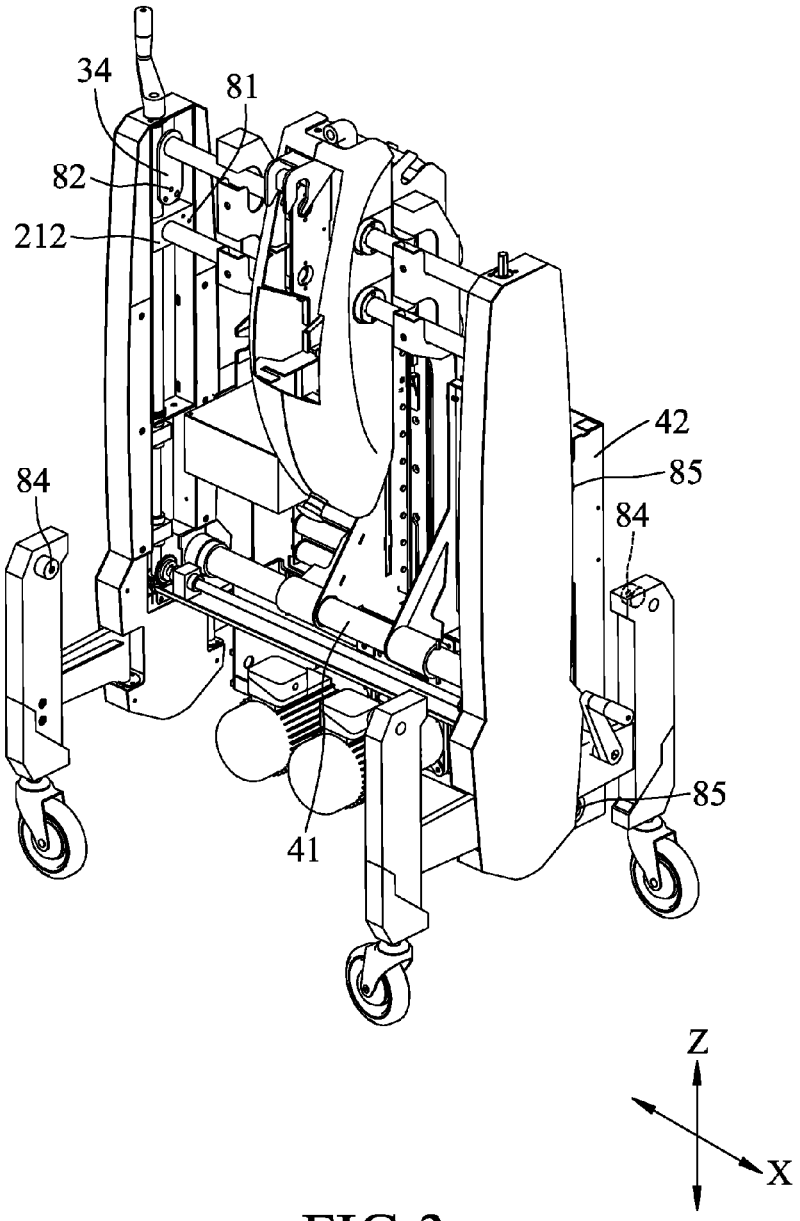
FIG. 3 is a perspective view of the foldable box sealing machine in a partially folded state where the base panel is placed in a second position.

Referring to FIGS. 1 to 3, the embodiment of a box sealing machine, which may be used to perform a sealing operation for boxes (not shown in the Figures), includes a main frame unit 2, an upper taping unit 3, a platform unit 4, a lower taping unit 5, a conveying unit 6, a leg frame unit 7 and a fastening unit 8.

The main frame unit 2 includes two spaced apart upright frame members 21 extending in a top-bottom (vertical) direction (Z) from a bottom end to a top end of the main frame unit 2. Each of the upright frame members 21 includes a frame body 211, and a moving body 212 mounted movably in the frame body 211 to move upward and downward along the frame body 211.

The upper taping unit 3 is mounted between the upright frame members 21 in proximity to the top end of the main frame unit 2, and includes an upper case 31 disposed between the upright frame members 21, an upper shaft unit that has two upper shafts 32 respectively journaled in two opposite sides of the upper case 31 and connected respectively to the moving bodies 212 of the upright frame members 21, an auxiliary rod unit that has two auxiliary rods 33 connected to two opposite sides of the upper case 31 and parallel to the upper shafts 32, and a pair of locking plates 34 respectively fixed to the auxiliary rods 33 and connected releasably to the moving bodies 212 of the upright frame members 21. Each moving body 212 is mounted on a screw rod 213 that is disposed vertically inside the frame body 211 of the corresponding one of the upright frame members 21 and that has a handle portion 214 operable to rotate the screw rod 213 to move upward or downward the corresponding moving body 212.

The upper case 31 is formed with an upper tape-receiving cavity 311 for accommodating an upper adhesive tape 91. Each upper shaft 32 extends along a left-right horizontal direction (X) that is transverse to the vertical direction (Z).

The upper case 31 is non-rotatable when the locking plates 34 are respectively connected to the moving bodies 212 and is rotatable about the upper shafts 32 when the locking plates 34 are disconnected from the moving bodies 212.

Figure 4:
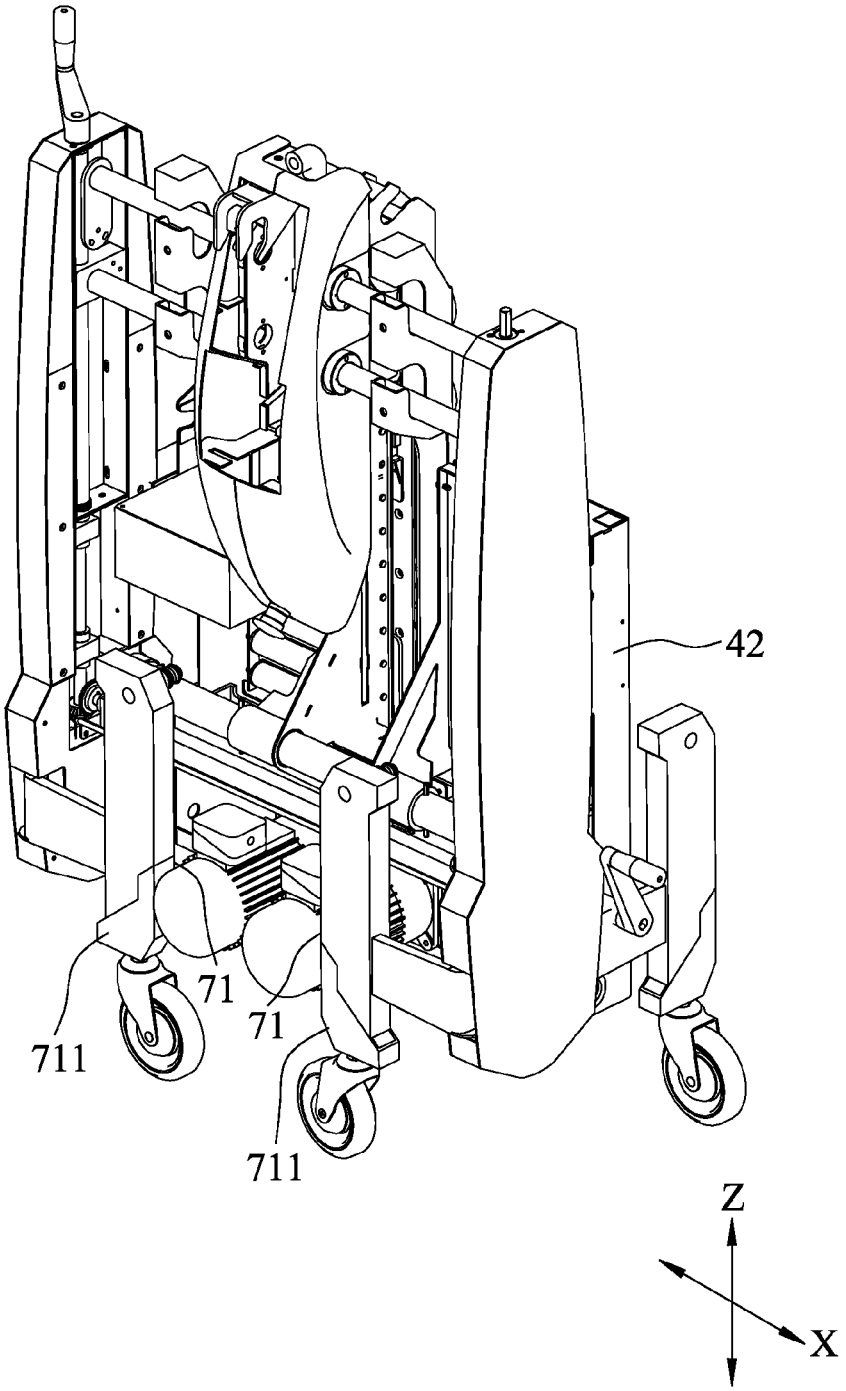
FIG. 4 is the same view as FIG. 3 but illustrating that front and rear leg frames are folded toward the base panel.
Figure 5:
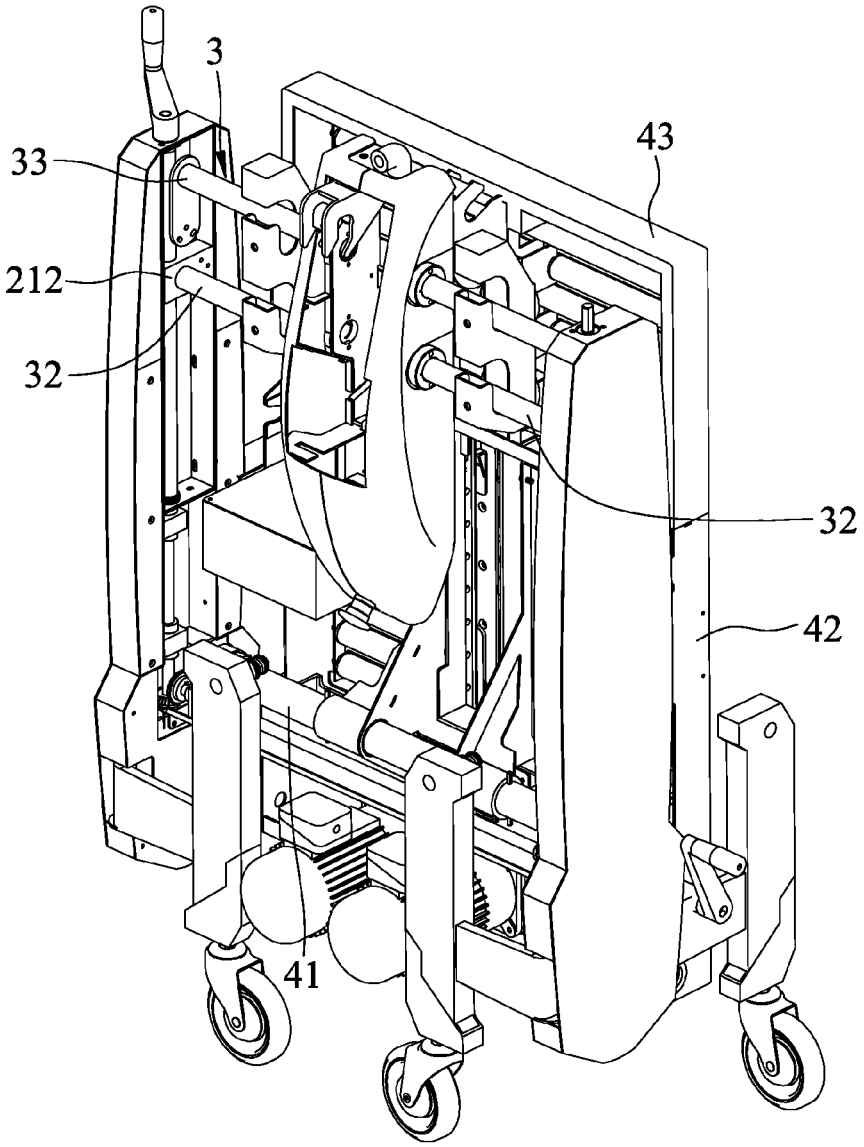
FIG. 5 is the same view as FIG. 4 but illustrating that the extension panel is re-connected to the base panel.

The platform unit 4 includes a lower shaft 41 mounted between the upright frame members 21 and disposed beneath the upper case 31 and the upper shafts 32, a base panel 42 that is disposed between the upright frame members 21 beneath the upper case 31 and that is operable to rotate about the lower shaft 41, and an extension panel 43 having a rear side connected removably to a front side of the base panel 42. The base panel 42 has a lower case-receiving recess 421 that is indented from the front side of the base panel 42. The base panel 42 is journaled on the lower shaft 41 to rotate between the upright frame members 21, and is rotatable between a first position (see FIGS. 1 and 2) and a second position (FIGS. 3-5).

The lower taping unit 5 is connected to the base panel 42, and includes a lower case 51 connected removably to the rear side of the extension panel 43 and received removably in the lower case-receiving recess 421. The lower case 51 is formed with a lower tape-receiving cavity 511 for accommodating a lower adhesive tape 92. The lower case 51 and the lower case-receiving recess 421 of the base panel 42 are connected to each other through a slide-and-rail interengagement manner.

The conveying unit 6 includes two clamping units 61 that are opposite to each other. Each clamping unit 61 has a conveyer belt 611. The conveyer belts 611 of the clamping units 61 respectively have belt surfaces which are opposite and parallel to each other.

The leg frame unit 7 includes two front leg frames 71 disposed in proximity to the bottom end of the main frame unit 2 and respectively connected to and extending downwardly from front sides of the bottoms of the upright frame members 21, and two rear leg frames 72 respectively connected to and extending downwardly from rear sides of the bottoms of the upright frame members 21.

Each front leg frame 71 has a front leg member 711 that is connected rotatably to the corresponding one of the front sides of the upright frame members 21 and that is able to turn toward the base panel 42, and a front wheel 712 attached to a bottom of the front leg member 711.

Each rear leg frame 72 has a rear leg member 721 that is connected rotatably to a corresponding one of the rear sides of the upright frame members 72 and that is able to turn toward the base panel 42, and a rear wheel 722 attached to a bottom of the rear leg member 721.

The fastening unit 8 is disposed on the main frame unit 2, the upper taping unit 3 and the platform unit 4, and includes a plurality of first screw holes 81 (FIG. 2) disposed in each of the moving bodies 212 of the upright frame members 21, a plurality of first through holes 82 (FIG. 2) disposed in each of the locking plates 34, and a plurality of first screw members 83 (only two are shown) that respectively extend through the first through holes 81 and that are respectively and threadedly engaged in the first screw holes 82 to fasten the locking plates 34 to the respective moving bodies 212.

The fastening unit 8 further includes four second screw holes 84 respectively disposed in the front and rear leg members 711, 721, four second through holes disposed in the base panel 42 to respectively register with the second screw holes 84 when the base panel 42 is the first position (see FIG. 2 in comparison with FIG. 3), and four second screw members 86 that extend respectively through the second through holes 85, that are respectively and threadedly engaged in the second screw holes 84 to fasten the front and rear leg members 711, 721 to the base panel 42.

The base panel 42 is rotatable between the first and second positions. In the first position (see FIGS. 1 and 2), the base panel 42 lies on a plane substantially parallel to a horizontal conveying direction (W) along which boxes (not shown) are conveyed during a box sealing operation. In the second position (FIGS. 3-5), the base panel 42 extends substantially parallel to the vertical or top-bottom direction (Z).

When it is desired to package and transport the box sealing machine, the box sealing machine may be folded by rotating the base panel 42 to the second position. When the base panel 42 is in the first position, the upper case 31 is in a position where the upper case 31 extends substantially horizontally. When the base panel 42 is rotated to the second position, the upper case 31 is rotated to a position where the upper case 31 extends substantially vertically.

In this embodiment, while the base panel 42 in the second position is placed at the rear side of the upright frame members 21 as shown in FIGS. 3-5, in other embodiments, the base panel 42 may be rotated and placed at the front side of the upright frame members 21.

Referring once again to FIGS. 1 to 3, the base panel 42 and the upper case 31 may be rotated by detaching the extension panel 43 from the base panel 42, detaching the first screw members 83 to unfasten the locking plates 34 from the moving bodies 212, and detaching the second screw members 86 to unfasten the front leg members 711 and the rear leg members 721 from the base panel 42. After the extension panel 43 and the first and second screw members 83, 86 are detached, the box sealing machine may be folded by rotating the base panel 42 and the upper case 31 by 90 degrees so that the base panel 42 and the upper case 31 become vertical. Thereafter, the front leg frames 71 may be turned to the front side of the base panel 42 (see FIG. 4), the rear leg frames 72 may be turned to the rear side of the base panel 42 (see FIG. 4), and the extension panel 43 may be re-connected to the base panel 42 (see FIG. 5). The folding operation of the box sealing machine is thus finished. The folded box sealing machine has a reduced size and is beneficial for the transportation thereof.

It is worth to mention that, in order to facilitate rotation of the base panel 42 to the second position from the first position, the upper case 31 may be rotated before rotation of the base panel 42 by moving downward the moving bodies 212 and by turning the auxiliary rods 33 upward to lie above the upper shafts 32 so that the upper case 31 extends substantially vertically as shown in FIG. 5.

While the present invention has been described in connection with what is considered the most practical embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A foldable box sealing machine for sealing a box, comprising:

a main frame unit extending uprightly from a bottom end to a top end thereof and including two spaced apart upright frame members extending in a top-bottom direction of said main frame unit;

an upper taping unit mounted on said main frame unit in proximity to said top end;

a platform unit having a base panel mounted rotatably between said upright frame members below said upper taping unit, and a lower shaft connected between said upright frame members and journaled in said base panel; and a lower taping unit mounted on said main frame unit below said upper taping unit;

wherein said base panel is rotatable relative to said upright frame members about said lower shaft between a first position where said base panel lies on a plane substantially parallel to a conveying direction (W) along which the box is conveyed during a box sealing operation, and a second position where said base panel extends substantially parallel to the top-bottom direction of said main frame unit.

2. The foldable box sealing machine as claimed in claim 1, wherein said upper taping unit is disposed between said upright frame members, and includes an upper case disposed rotatably between said upright frame members, and two upper shafts respectively journaled to two opposite sides of said upper case and connected between said upright frame members.

3. The foldable box sealing machine as claimed in claim 2, wherein said lower shaft is located below said upper shafts, and said platform unit further has an extension panel disposed in front of said base panel, said extension panel having a rear side removably connected to a front side of said base panel, said base panel being rotatable about said lower shaft.

4. The foldable box sealing machine as claimed in claim 3, wherein said base panel has a lower case-receiving recess that is indented from said front side of said base panel, said lower taping unit having a lower case disposed removably in said lower case-receiving recess and removably connected to said rear side of said extension panel, said lower case having a lower tape-receiving cavity.

5. The foldable box sealing machine as claimed in claim 2, further comprising a leg frame unit which includes two front leg frames disposed in proximity to said bottom end of said main frame unit and respectively connected to and extending downwardly from front sides of said upright frame members, and two rear leg frames disposed in proximity to said bottom end of said main frame unit and respectively connected to and extending downwardly from rear sides of said upright frame members.

6. The foldable box sealing machine as claimed in claim 5, wherein each of said front leg frame has a front leg member that is connected rotatably to a corresponding one of said front sides of said upright frame members and that is able to turn toward said base panel, and a front wheel attached to a bottom of said front leg member, and each of said rear leg frame has a rear leg member that is connected rotatably to a corresponding one of said rear sides of said upright frame members and that is able to turn toward said base panel, and a rear wheel attached to a bottom of said rear leg member.

7. The foldable box sealing machine as claimed in claim 5, wherein each of said upright frame members has a frame body connected to a corresponding one of said front leg frames and a corresponding one of said rear leg frames, and a moving body that is disposed movably in said frame body to move upward and downward along said frame body and that is connected to a corresponding one of said upper shafts.

8. The foldable box sealing machine as claimed in claim 7, wherein said upper taping unit further has two auxiliary rods respectively connected to said two opposite sides of said upper case and parallel to said upper shafts, and two locking plates each of which is connected fixedly to one of said auxiliary rods and is connected releasably to one of said moving bodies of said upright frame members, said upper case being non-rotatable when said locking plates are respectively connected to said moving bodies and being rotatable about said upper shafts when said locking plates are disconnected from said moving bodies.

9. The foldable box sealing machine as claimed in claim 8, further comprising a fastening unit which includes at least one first screw hole disposed in each of said moving bodies of said upright frame members, at least one first through hole disposed in each of said locking plates, and at least one first screw member that extends through said at least one first through hole, and that is threadedly engaged in said at least one first screw hole to fasten a corresponding one of said locking plates to a corresponding one of said moving bodies.

10. The foldable box sealing machine as claimed in claim 9, wherein said fastening unit further includes four second screw holes respectively disposed in said front and rear leg frames, four second through holes disposed in said base panel to register with said second screw holes, respectively, and four second screw members that extend respectively through said second through holes, that are respectively and threadedly engaged in said second screw holes to fasten said front and rear leg frames to said base panel.

11. The foldable box sealing machine as claimed in claim 1, further comprising a conveying unit which includes two clamping units that are opposite to each other, each of said clamping units having a conveyer belt, said conveyer belts of said clamping units respectively having belt surfaces which are opposite and parallel to each other.

* * * * *